US007682135B2

(12) United States Patent
Ueki et al.

(10) Patent No.: US 7,682,135 B2
(45) Date of Patent: Mar. 23, 2010

(54) VARIABLE DISPLACEMENT PUMP

(75) Inventors: Takeshi Ueki, Haga-gun (JP); Shingo Ishige, Haga-gun (JP); Yoshinobu Yamada, Haga-gun (JP)

(73) Assignee: Showa Corporation, Gyoda-Shi (JP)

( * ) Notice: Subject to any disclaimer, the term of this patent is extended or adjusted under 35 U.S.C. 154(b) by 769 days.

(21) Appl. No.: 11/610,066

(22) Filed: Dec. 13, 2006

(65) Prior Publication Data

US 2007/0280842 A1 Dec. 6, 2007

(30) Foreign Application Priority Data

May 30, 2006 (JP) ..... 2006-150517

(51) Int. Cl.
*F04B 49/00* (2006.01)

(52) U.S. Cl. ..... 417/220; 418/30

(58) Field of Classification Search ..... 418/30, 418/75, 77, 80, 82; 417/213, 218, 219, 220, 417/302, 303, 304
See application file for complete search history.

(56) References Cited

U.S. PATENT DOCUMENTS 2,635,551 A * 4/1953 De Lancey ..... 417/220
5,273,408 A * 12/1993 Yuge ..... 418/30
5,538,400 A 7/1996 Konishi et al.
6,352,415 B1 3/2002 Uchino

FOREIGN PATENT DOCUMENTS

JP 3501990 5/2000

* cited by examiner

*Primary Examiner*—Devon C Kramer
*Assistant Examiner*—Dnyanesh Kasture
(74) *Attorney, Agent, or Firm*—Babcock IP, PLLC

(57) ABSTRACT

In a variable displacement pump, a first groove always connected to a second hydraulic chamber is provided in a slide surface of a cam ring facing to an end surface of a side plate, and a second groove always connected to a suction port is provided in the end surface of the side plate, whereby when the cam ring is moved to a moving end side in which a volumetric capacity of a pump chamber is reduced, the first groove and the second groove are connected, and the second hydraulic chamber can be connected to the suction port by the grooves.

6 Claims, 4 Drawing Sheets

VARIABLE DISPLACEMENT PUMP

BACKGROUND OF THE INVENTION

1. Field of the Invention

The present invention relates to a variable displacement pump. The pump may be used, for example, in a hydraulic power steering apparatus for a motor vehicle or the like.

2. Description of the Related Art

A variable displacement pump used in a hydraulic power steering apparatus for a motor vehicle is driven by an engine of the motor vehicle, and a discharge flow rate is increased in accordance that a rotating speed of the engine or a rotating speed of the pump becomes higher. On the contrary, in the hydraulic power steering apparatus for the motor vehicle, a high assist force is necessary during stopping or a low speed traveling region, and lower assist force is desirable in a high speed traveling region, to improve a steering property and driving stability.

A variable displacement pump is described in Japanese Patent No. 3501990 (patent document 1). A rotor is fixed to a pump shaft inserted to a pump casing so as to be rotationally driven, and accommodating a plurality of vanes in a groove so as to be movable in a radial direction, a cam ring fitted to a fitting hole within the pump casing so as to be movable and displaceable, forming a pump chamber with respect to an outer peripheral portion of the rotor and forming first and second hydraulic chambers with respect to the pump casing, and a discharge flow rate control apparatus selectively introducing a pressure in an upstream side of a main throttle provided in a pump discharge side passage and a pressure in a pump suction side to the first hydraulic chamber, and selectively introducing a pressure in a downstream side of the main throttle and a pressure in the pump suction side to the second hydraulic chamber.

In a low speed traveling region in which the rotating speed of the pump is low, a switch valve of the discharge flow rate control apparatus is positioned at an original position so as to connect the first hydraulic chamber to the pump suction side and connect the second hydraulic chamber to the downstream side of the main throttle in the pump discharge side. Accordingly, the cam ring is maintained in a side in which a volumetric capacity of the pump chamber is maximized on the basis of a pressure difference between the first hydraulic chamber and the second hydraulic chamber, and the pump discharge flow rate is increased in proportion to the rotating speed.

If the rotating speed of the pump is increased, the switch valve of the discharge flow rate control apparatus is moved so as to connect the upstream side of the main throttle to the first hydraulic chamber, and connect the second hydraulic chamber to the pump suction side. Accordingly, the cam ring is moved to the side in which the volumetric capacity of the pump chamber is made smaller, and a pump discharge flow rate V cancels a flow rate increase V1 caused by an increase of the rotating speed and a flow rate decrease V2 caused by a volumetric capacity reduction of the pump chamber, with respect to the increase of the rotating speed, thereby intending to maintain a fixed flow rate.

In the variable displacement pump described in the patent document 1, in the case that the cam ring reaches the moving end side in which the volumetric capacity of the pump chamber is minimized, in the high rotation region of the pump, the flow rate decrease V2 caused by the volumetric capacity reduction of the pump chamber hits the peak. Accordingly, the discharge flow rate V of the pump obtains only the flow rate increase V1 caused by the increase of the rotating speed and is increased. Therefore, an assist force in the high speed driving region becomes higher, and a steering feeling is rapidly light so as to become unstable.

SUMMARY OF THE INVENTION

An object of the present invention is to maintain a discharge flow rate in a high rotating region constants in a variable displacement pump.

The present invention relates to a variable displacement pump comprising: a rotor fixed to a pump shaft inserted to a pump casing so as to be rotationally driven, and structured such that a plurality of vanes are accommodated in grooves so as to be movable in a radial direction; a cam ring fitted to a fitting hole within a pump casing so as to be movable and displaceable, forming a pump chamber with respect to an outer peripheral portion of the rotor, and forming first and second hydraulic chambers with respect to the pump casing; a discharge flow rate control apparatus introducing a pressure in an upstream side of a main throttle provided in a pump discharge side passage to the first hydraulic chamber, and introducing a pressure in a downstream side of the main throttle to the second hydraulic chamber; and the discharge flow rate control apparatus having a switch valve apparatus which is actuated on the basis of a pressure difference between the upstream and downstream sides of the main throttle, and controls a supply fluid pressure to the first hydraulic chamber in correspondence to a discharge flow rate of the pressurized fluid from the pump chamber. A suction port open to a suction region of the pump chamber is provided in an end surface of a side plate or a cover fixed to the pump casing so as to close a side portion of the cam ring. A first groove always connected to the second hydraulic chamber is provided in a slide surface of the cam ring facing to the end surface of the side plate or the cover. A second groove always connected to the suction port is provided in the end surface of the side plate or the cover. When the cam ring is moved to a moving end side in which a volumetric capacity of the pump chamber is reduced, the first groove and the second groove are connected, and the second hydraulic chamber is connectable to the suction port by the grooves.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings.

DESCRIPTION OF THE PREFERRED EMBODIMENTS

Figure 1:
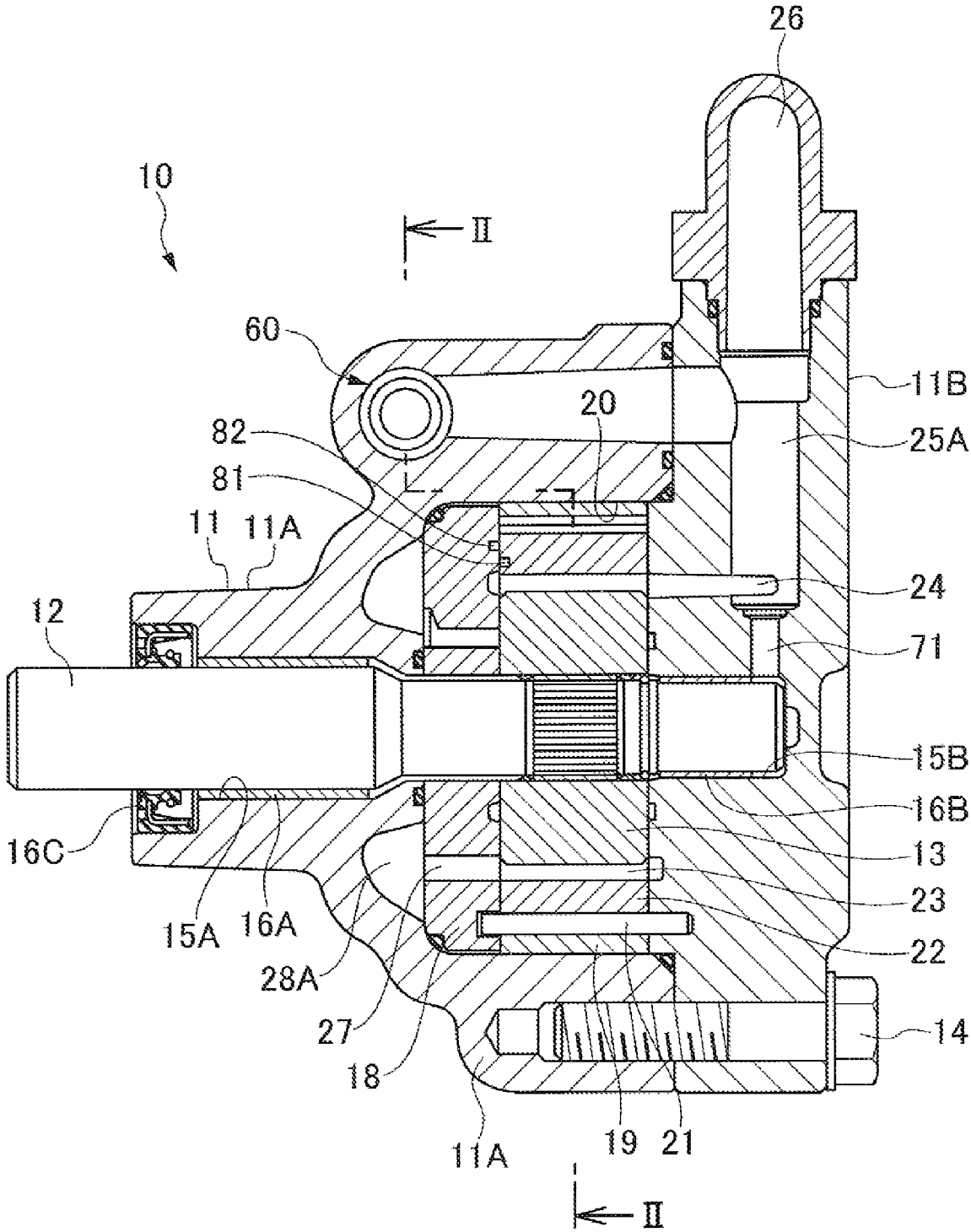
FIG. 1 is a cross sectional view showing a variable displacement pump.
Figure 2:
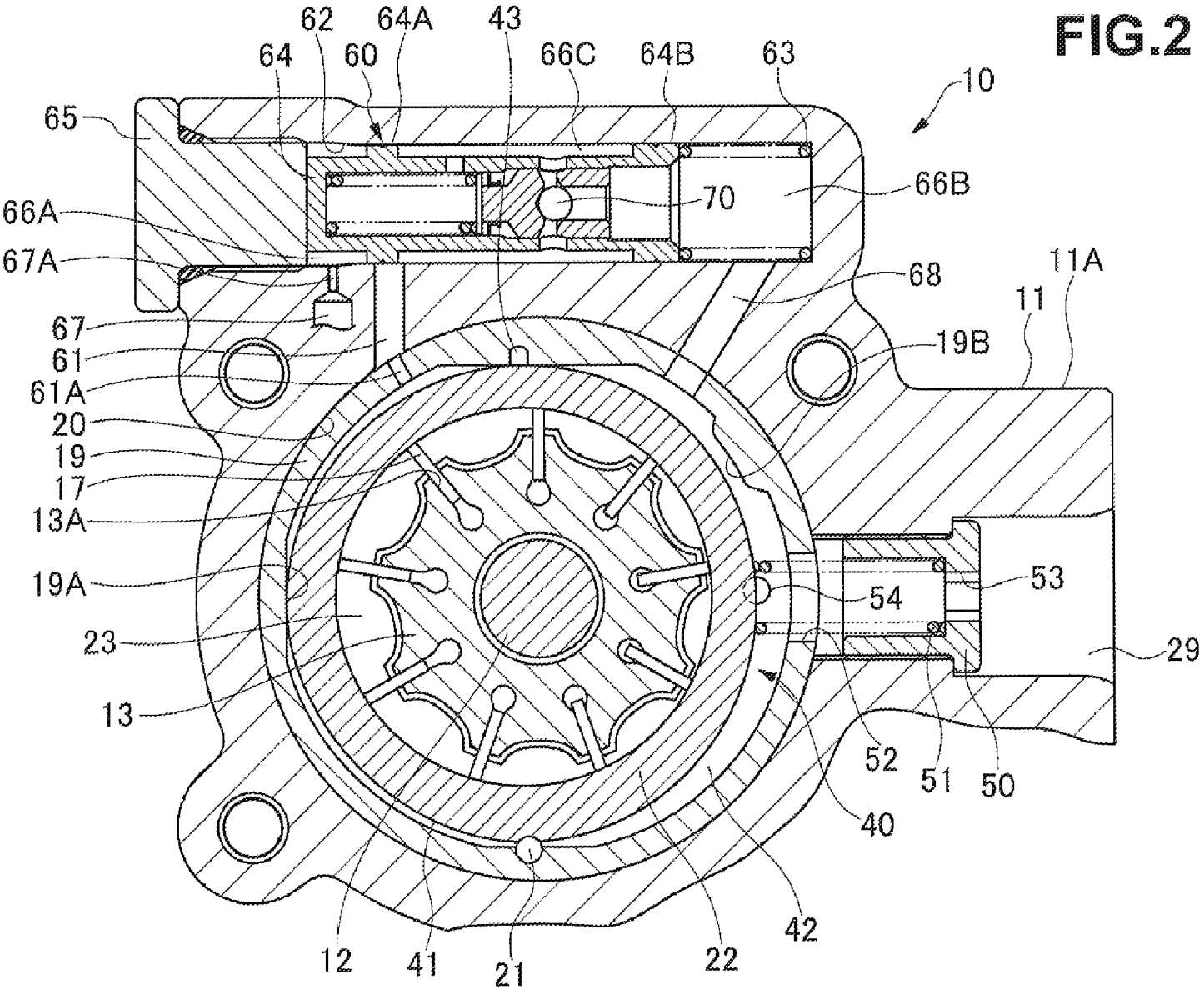
FIG. 2 is a cross sectional view along a line II-II in FIG. 1.

A variable displacement pump 10 corresponds to a vane pump forming a hydraulic pressure generating source of hydraulic equipment such as a power steering apparatus of a motor vehicle, and has a rotor 13 fixed to a pump shaft 12 inserted to a pump casing 11 by serration so as to be rotationally driven, as shown in FIGS. 1 and 2. The pump casing 11 is structured by integrating a pump housing 11A and a cover 11B by a bolt 14. The pump housing 11A is provided with a cup-shaped concave space accommodating a pump constituting element such as the rotor 13 or the like, and the cover 11B is combined with the pump housing 11A in such a manner as to close an opening portion of the concave space so as to be integrated. The pump shaft 12 is supported to a bearing 15A (a bush) provided in a support hole 15A of the pump housing 11A, and a bearing 16B (a bush) provided in a support hole 15B of the cover 11B. An oil seal 16C is fitted to the support hole 15A.

The rotor 13 accommodates vanes 17 in grooves 13A provided at a plurality of positions in a peripheral direction. Thereby, each of the vanes 17 is movable in a radial direction along the corresponding groove 13A.

A side plate 18 and an outer case 19 are fitted in a laminated state to a fitting hole 20 of the pump housing 11A of the pump casing 11, and these are fixedly held by the cover 11B from a side portion in a state of being positioned in the peripheral direction by a supporting point pin 21 mentioned below. One end of the supporting point pin 21 is installed and fixed to the cover 11B.

A cam ring 22 is installed to the outer case 19 mentioned above fixed to the pump housing 11A of the pump casing 11. A side portion of the cam ring 22 is closed by the cover 11B. The cam ring 22 surrounds the rotor 13 with an amount of eccentricity from the rotor 13, and forms a pump chamber 23 with respect to an outer peripheral portion of the rotor 13, between the side plate 18 and the cover 11B. Further, a suction port 24 provided in an end surface of the cover 11B is open to a suction region in an upstream side in a rotor rotating direction of the pump chamber 23, and a suction port 26 of the pump 10 is communicated with the suction port 24 via a suction passage (a drain passage) 25A provided in the housing 11A and the cover 11B. On the other hand, a discharge port 27 provided in an end surface of the side plate 18 is open to a discharge region in a downstream side in the rotor rotating direction of the pump chamber 23, and a discharge port 29 of the pump 10 is communicated with the discharge port 27 via a high pressure chamber 28A provided in the housing 11A and a discharge passage (not shown). A discharge fluid pressure discharged by the pump chamber 23 is supplied to hydraulic equipment such as a power steering apparatus from the discharge port 27.

Accordingly, in the variable displacement pump 10, in the case that the rotor 13 is rotationally driven by the pump shaft 12, and the vane 17 of the rotor 13 is pressed to the cam ring 22 on the basis of a centrifugal force so as to be rotated, the volumetric capacity surround by the adjacent vanes 17 and the cam ring 22 is enlarged together with the rotation in an upstream side in the rotor rotating direction of the pump chamber 23, and a working fluid is sucked from the suction port 24. In a downstream side in the rotor rotating direction of the pump chamber 23, the volumetric capacity surround by the adjacent vanes 17 and the cam ring 22 is reduced together with the rotation, and the working fluid is discharged from the discharge port 27.

The variable displacement pump 10 has a discharge flow rate control apparatus 40. The discharge flow rate control apparatus 40 is structured such that the supporting point pin 21 mentioned above is mounted in a vertical bottom portion of the outer case 19 mentioned above fixed to the pump casing 11, a vertical bottom portion of the can ring 22 is supported to the supporting point pin 21, and the cam ring 22 can be swung and displaced within the outer case 19.

In this case, the outer case 19 is structured such that a cam ring swing regulating stopper 19A brought into contact with an outer peripheral surface of the cam ring 22 is formed in a protruding manner in a part of an inner peripheral surface forming a first hydraulic chamber 41, and a swing limit of the cam ring 22 for maximizing the volumetric capacity of the pump chamber 23 is regulated as mentioned below. Further, the outer case 19 is structured such that a cam ring swing regulating stopper 19B brought into contact with the outer peripheral surface of the cam ring 22 is formed in a protruding manner in a part of an inner peripheral surface forming a second hydraulic chamber 42 mentioned below, and a swing limit of the cam ring 22 for minimizing the volumetric capacity of the pump chamber 23 is regulated as mentioned below.

In the discharge flow rate control apparatus 40, first and second hydraulic chambers 41 and 42 are formed between the cam ring 22 and the outer case 19. In other words, the first hydraulic chamber 41 and the second hydraulic chamber 42 are divided between the cam ring 22 and the outer case 19 by the supporting point pin 21 and a seal material 43 provided at an axially symmetrical position thereof. At this time, the first and second hydraulic chambers 41 and 42 are comparted in both side portions between the cam ring 22 and the outer case 19 by the cover 11B and a side plate 18. The side plate 18 is provided with a communication groove communicating the first hydraulic chambers 41 separated in both sides of the stopper 19A with each other at a time when the cam ring 22 conies into collision with the cam ring swing regulating stoppers 19A and 19B mentioned above of the outer case 19, and a communication groove communicating the second hydraulic chambers 42 separated in both sides of the stopper 19B with each other.

Further, the discharge flow rate control apparatus 40 is structured such that a spring presser foot 50 is screwed to an opposite side to the first hydraulic chamber 41 with respect to the cam ring 22 within the discharge port 29 of the pump housing 11A constituting the pump casing 11, and a spring 51 serving as an energizing means supported by the spring presser foot 50 is brought into contact with the outer surface of the cam ring 22 through a communication hole 52 provided in the outer case 19. The spring 51 energizes the cam ring 22 in a direction of maximizing a volumetric capacity (a pump capacity) of the pump chamber 23 with respect to the outer peripheral portion of the rotor 13. The spring presser foot 50 is provided with a cavity accommodating the communication hole 52, and is constituted by a cylindrical hollow body provided with one or more discharge hole 53 constituting a part of the discharge port 29.

The discharge flow rate control apparatus 40 is provided with a main throttle 54 in a middle portion of a discharge passage (not shown). The main throttle 54 is constituted by a hole portion 54A pierced in such a manner as to be open to an end surface facing to the second hydraulic chamber 42 of the cover 11B closing the side portion of the cam ring 22 swinging and displacing within the outer case 19 fixed to the pump housing 11A, and a side portion 54B of the cam ring 22 changing an opening area of the open end of the hole portion 54A with respect to the second hydraulic chamber 42 in correspondence to the swing of the cam ring 22. Further, the discharge flow rate control apparatus 40 selectively introduces the pressure in the upstream side of the main throttle 54 and the pressure in the pump suction side to the first hydraulic chamber 41 applying the swinging displacement in the direction of minimizing the volumetric capacity of the pump chamber 23 to the cam ring 22 via a switch valve apparatus 60 mentioned below and introduces the pressure in the downstream side of the main throttle 54 to the second hydraulic chamber 42 applying the swinging displacement in the direction of maximizing the volumetric capacity of the pump chamber 23 to the cam ring 22. The cam ring 22 is moved against the energizing force of the spring 51 and the volumetric capacity of the pump chamber 23 is changed so as to control the discharge flow rate of the pump 10, on the basis of a balance of the pressures applied to the first hydraulic chamber 41 and the second hydraulic chamber 42.

In this case, the discharge flow rate control apparatus 40 has the switch valve apparatus 60 which is actuated on the basis of the pressure difference in the upstream and downstream sides of the main throttle 54 and controls a supply fluid pressure to the first hydraulic chamber 41 in correspondence to the discharge flow rate of the pressure fluid from the pump chamber 23. In particular, the switch valve apparatus 60 is interposed between a first communication path 61 connected to the first hydraulic chamber 41 and a second communication path 67 in an upstream side of the main throttle 54 of the discharge passage (not shown), closes the first hydraulic chamber 41 with respect to the second communication path 67 in the low rotating region of the pump 10, on the basis of a cooperation with a throttle 61A provided in the first communication path 61, and connects the first hydraulic chamber 41 with the second communication path 67 in the high rotating region.

In this case, the swing valve apparatus 60 is structured such that a spring 63 and a switch valve 64 are accommodated in a valve storage hole 62 pierced in the pump housing 11A, and a switch valve 64 energized by the spring 63 is carried by a cap 6*a* screwed with the pump housing 11A. The switch valve 64 is provided with a valve body 64A closely brought into slidable contact with the valve storage hole 62, and a switch valve body 64B, the second communication path 67 in the upstream side of the main throttle 54 of the discharge passage (not shown) is communicated with a pressurizing chamber 66A provided in one end side of the valve body 64A, and a communication path 68 in a downstream side of the main throttle 54 of the discharge passage (not shown) is communicated with a back pressure chamber 66B in which the spring 63 provided in the other end side of the switch valve body 64B is stored, via the second hydraulic chamber 42. Further, the suction passage (the drain passage) 25A mentioned above is formed in a penetrating manner in a drain chamber 66C between the valve body 64A and the switch valve body 64B, and is communicated with a tank. The valve body 64A can open and close the first communication path 61 mentioned above. In other words, in the low rotating region in which the discharge pressure of the pump 10 is low, the switch valve 64 is set to the original position shown in FIG. 2 on the basis of the energizing force of the spring 63, the pressurizing chamber 66A is closed with respect to the first communication path 61 with the first hydraulic chamber 41 by the valve body 64A, and the drain chamber 66C is conducted with the first communication path 61 with the first hydraulic chamber 41, so that the pressure in the pump suction side is introduced to the first hydraulic chamber 41. In the middle and high rotating regions of the pump 10, the switch valve 64 is moved on the basis of the high-pressure fluid of the second communication path 67 applied to the pressurizing chamber 66A, the pressurizing chamber 66A is opened with respect to the first communication path 61 with the first hydraulic chamber 41 by the valve body 64A, and the high-pressure fluid in the upstream side of the main throttle 54 applied to the pressurizing chamber 66A from the second communication path 67 is introduced to the first hydraulic chamber 41. In this case, a throttle 67A is provided in the second communication path 67, thereby making it possible to absorb a pulsation from the upstream side of the main throttle 54.

Figure 3:
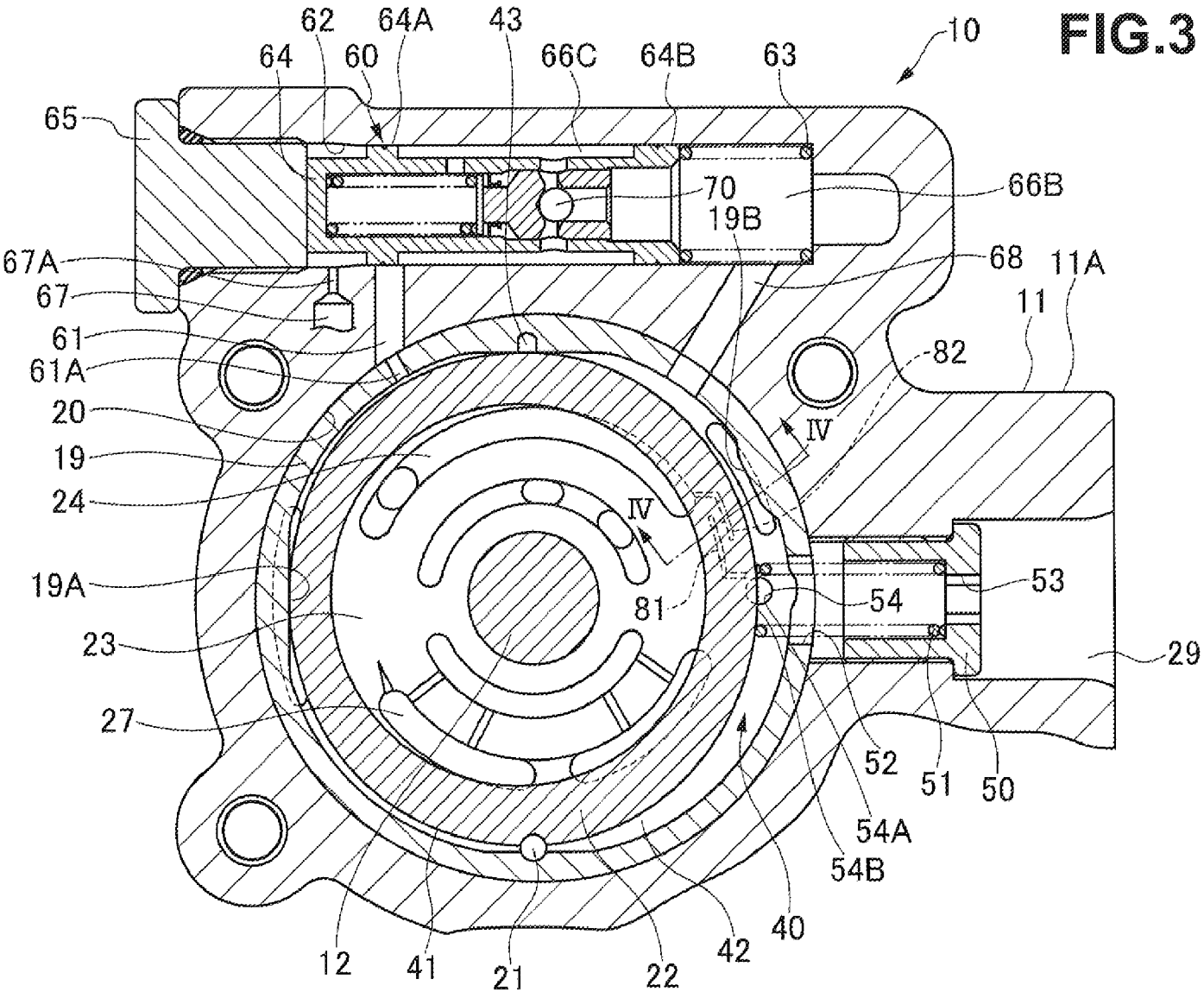
FIG. 3 is a schematic view showing a first groove provided in a cam ring and a second groove provided in a cover.
Figure 4:
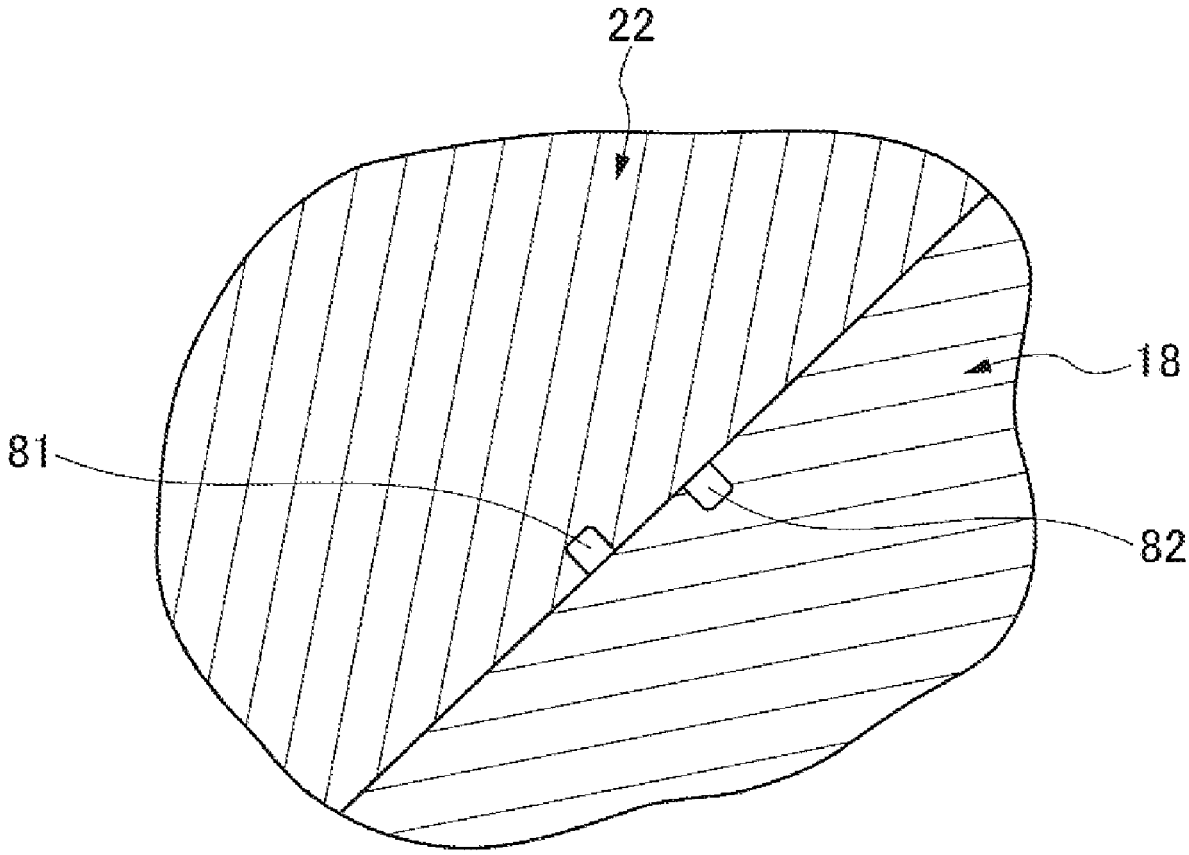
FIG. 4 is a cross sectional view along a line IV-IV in FIG. 3.

Accordingly, in the discharge flow rate control apparatus 40, as shown in FIGS. 3 and 4, a sliding surface of the cam ring 22 facing to the end surface of the side plate 18 is provided with a first groove 81 connected so as to be always directly communicated with the second hydraulic chamber 42. Further, the end surface of the side plate 18 is provided with a second groove 82 always connected so as to be directly communicated with the suction port 24. Further, when the cam ring 22 is moved to a moving end side in a side in which the volumetric capacity of the pump chamber 23 is reduced, the first groove 81 and the second groove 82 are connected, and the second hydraulic chamber 42 is connected to the suction port 24 by the grooves 81 and 82.

A discharge flow rate characteristic of the pump 10 using the discharge flow rate control apparatus 40 is as follows.

(1) In the low speed traveling region of the motor cycle in which the rotating speed of the pump 10 is low, the pressure of the fluid discharged from the pump chamber 23 so as to reach the pressurizing chamber 66A of the switch valve apparatus 60 is still low, the switch valve 64 is positioned at the original position, and the switch valve 64 closes the pressurizing chamber 66A with respect to the first communication path 61 with the first hydraulic chamber 41, and closes the drain chamber 66C with respect to the first communication path 61 with the first hydraulic chamber 41. Therefore, the pressure in the upstream side of the main throttle 54 is not supplied to the first hydraulic chamber 41, and the pressure in the downstream side of the main throttle 54 is applied to the second hydraulic chamber 42. Accordingly, the cam ring 22 is maintained in the side in which the volumetric capacity of the pump chamber 23 is maximized, on the basis of the pressure difference between the first hydraulic chamber 41 and the second hydraulic chamber 42 and the energizing force of the spring 51, and the discharge flow rate of the pump 10 is increased in proportion to the rotating speed.

(2) If the pressure of the fluid discharged from the pump chamber 23 so as to reach the pressurizing chamber 66A of the switch valve apparatus 60 becomes higher on the basis of the increase of the rotating speed of the pump 10, the switch valve apparatus 60 moves the switch valve 64 against the energizing force of the spring 63 so as to open the pressurizing chamber 66A with respect to the first communication path 61 with the first hydraulic chamber 41. Accordingly, the pressure in the first hydraulic chamber 41 is increased, and the cam ring 22 is moved to the side in which the volumetric capacity of the pump chamber 23 is reduced. Therefore, the discharge flow rate of the pump 10 cancels the flow rate increase caused by the increase of the rotating speed, and the flow rate decrease caused by the volumetric capacity reduction of the pump chamber 23, with respect to the increase of the rotating speed, and a constant flow rate is maintained.

(3) If the cam ring 22 reaches the moving end side in which the volumetric capacity of the pump chamber 23 is minimized, in the high rotating region of the pump 10 in which the rotating speed of the pump 10 is further increased, the first groove 81 of the cam ring 22 and the second groove 82 of the side plate 18 are connected on the basis of the swing motion of the cam ring 22, and the second hydraulic chamber 42 is connected to the suction port 24 from the grooves 81 and 82. At this time, in the pump discharge flow rate V, the flow rate decrease V2 caused by the volumetric capacity reduction of the pump chamber 23 hits the peak, but the flow rate increase V1 caused by the increase of the pump rotating speed is flowed back to the suction port 24 mentioned above via the second hydraulic chamber 42 connected to the downstream side of the main throttle 54 of the discharge passage after passing therethrough. A flow-back amount to the suction port 24 from the discharge path (the second hydraulic chamber 42) can be approximately set to an entire amount of the flow rate increase V1 on the basis of the setting of flow path areas of the first groove 81 and the second groove 82. Therefore, the discharge flow rate actually supplied from the discharge passage to the hydraulic equipment, such as a power steering apparatus, is maintained constant.

In this case, the pump 10 has a relief valve 70 serving as a switch valve relieving an excessive hydraulic pressure in the pump discharge side, between the high pressure chamber 28A and the suction passage (the drain passage) 25A, and the drain chamber 66C. Further, the pump 10 is structured such that a lubricating oil supply path 71 extending toward the bearing 16B of the pump shaft 12 from the suction passage 25A is pierced in the cover 11B, and a lubricating oil return path 72 (not shown) returning to the suction passage 25B from a portion around the bearing 16A of the pump shaft 12 is pierced in the pump housing 11A.

In accordance with the present embodiment, the following operations and effects can be obtained.

(a) When the cam ring 22 reaches the moving end side in which the volumetric capacity of the pump chamber 23 is minimized, in the high rotating region of the pump 10, the first groove 81 of the cam ring 22 and the second groove 82 of the side plate 18 are connected, and the second hydraulic chamber 42 is connected to the suction port 24 from the grooves 81 and 82. At this time, in the discharge flow rate V of the pump 10, the flow rate decrease V2 caused by the volumetric capacity reduction of the pump chamber 23 hits the peak. Further, the flow rate increase V1 caused by the increase of the pump rotating speed is flowed back to the suction port 24 mentioned above via the second hydraulic chamber 42 connected to the downstream side of the main throttle 54 of the discharge passage after passing therethrough. A flow-back amount to the suction port 24 can be approximately set to an entire amount of the flow rate increase V1 on the basis of the setting of the flow path areas of the first groove 81 and the second groove 82. Therefore, the discharge flow rate actually supplied to the hydraulic equipment such as the power steering apparatus from the discharge passage is maintained constant.

(b) It is possible to maintain the discharge flow rate in the high speed traveling region constant by applying the variable displacement pump 10 mentioned in the item (a) to the hydraulic power steering apparatus for the motor vehicle, whereby the steering feeling is stable without becoming rapidly light.

In this case, in the embodiment mentioned above, the second groove 82 is provided in the end surface of the side plate 18. Alternatively, the second groove 82 may be provided in the end surface of the cover 11B. In this case, the first groove 81 is provided in the slide surface of the cam ring 22 facing to the end surface of the cover 11B.

As heretofore explained, embodiments of the present invention have been described in detail with reference to the drawings. However, the specific configurations of the present invention are not limited to the illustrated embodiments but those having a modification of the design within the range of the presently claimed invention are also included in the present invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be encompassed within a scope of equivalents thereof with respect to the features set out in the appended claims.

What is claimed is:

1. A variable displacement pump comprising:

a rotor fixed to a pump shaft inserted to a pump casing so as to be rotationally driven, and structured such that a plurality of vanes are accommodated in grooves so as to be movable in a radial direction;

a cam ring fitted to a fitting hole within a pump casing so as to be movable and displaceable, forming a pump chamber with respect to an outer peripheral portion of the rotor, and forming first and second hydraulic chambers with respect to the pump casing;

a discharge flow rate control apparatus introducing a pressure in an upstream side of a main throttle provided in a pump discharge side passage to the first hydraulic chamber, and introducing a pressure in a downstream side of the main throttle to the second hydraulic chamber; and the discharge flow rate control apparatus having a switch valve apparatus which is actuated on the basis of a pressure difference between the upstream and downstream sides of the main throttle, and controls a supply fluid pressure to the first hydraulic chamber in correspondence to a discharge flow rate of the pressurized fluid from the pump chamber, wherein a suction port open to a suction region of the pump chamber is provided in an end surface of a side plate or a cover fixed to the pump casing so as to close a side portion of the cam ring, wherein a first groove always connected to the second hydraulic chamber is provided in a slide surface of the cam ring facing to the end surface of the side plate or the cover, wherein a second groove always connected to the suction port is provided in the end surface of the side plate or the cover, and wherein when the cam ring is moved to a moving end side in which a volumetric capacity of the pump chamber is reduced, the first groove and the second groove are connected, and the second hydraulic chamber is connectable to the suction port by the grooves.

2. A variable displacement pump as claimed in claim 1, wherein when the cam ring is moved to the moving end side in which the volumetric capacity of the pump chamber is minimized, in a high rotating region of the pump, the first groove and the second groove are connected on the basis of a swing motion of the cam ring, and the second hydraulic chamber is connected to the suction port by the grooves, and a flow rate increase of a working fluid caused by an increase of the pump rotating speed is flowed back to the suction port via the second hydraulic chamber connected to a downstream side of a main throttle of the discharge passage.

3. A variable displacement pump as claimed in claim 2, wherein when a flow-back amount of the working fluid to the suction port from the discharge passage is set to an entire amount of the flow rate increase caused by the increase of the pump rotating speed, on the basis of sitting of flow path areas of the first groove and the second groove.

4. A hydraulic power steering apparatus for a motor vehicle using the variable displacement pump as claimed in claim 1.

5. A hydraulic power steering apparatus for a motor vehicle using the variable displacement pump as claimed in claim 2.

6. A hydraulic power steering apparatus for a motor vehicle using the variable displacement pump as claimed in claim 3.

* * * * *